US008142214B1

(12) United States Patent
Huang

(10) Patent No.: US 8,142,214 B1
(45) Date of Patent: Mar. 27, 2012

(54) JOINT STRUCTURE

(75) Inventor: Chuan-Hsi Huang, Xinbei (TW)

(73) Assignee: Dvina Co., Ltd. (TW)

( * ) Notice: Subject to any disclaimer, the term of this patent is extended or adjusted under 35 U.S.C. 154(b) by 0 days.

(21) Appl. No.: 13/016,644

(22) Filed: Jan. 28, 2011

(51) Int. Cl.
*H01H 29/00* (2006.01)

(52) U.S. Cl. ..... 439/188

(58) Field of Classification Search ..... 439/188, 439/944; 333/132, 136, 260
See application file for complete search history.

(56) References Cited

U.S. PATENT DOCUMENTS 3,040,288 A * 6/1962 Edlen et al. ..... 439/452
5,318,459 A * 6/1994 Shields ..... 439/527
5,598,132 A * 1/1997 Stabile ..... 333/22 R
6,270,367 B1 * 8/2001 Bussard ..... 439/188
7,014,502 B2 * 3/2006 Rasmussen ..... 439/578

* cited by examiner

*Primary Examiner* — Tulsidas C Patel
*Assistant Examiner* — Phuongchi Nguyen
(74) *Attorney, Agent, or Firm* — Bruzga & Associates; Charles E. Bruzga; Jay S. Patlumudi

(57) ABSTRACT

A joint structure effective in reducing return loss and insertion loss of signals includes a body, a sleeve, a resilient element, a metallic pipe, a rod, two washers, and a packing. The sleeve is disposed in the body and penetrable by a terminal line. The sleeve has a positioning ring circumferentially in tight contact with the body and receives the resilient element. The circumference of the resilient element is integrally formed as a unitary unit and has longitudinal slashes whose ends are provided with bumps, respectively. A positioning ring is disposed at the other end of the resilient element. The resilient element and the rod are insertable into two ends of the metallic pipe, respectively. The rod has an end for penetrating the washers and packing, and has a positioning ring for enabling engagement and positioning of the washers, the packing, the rod, and the metallic pipe.

2 Claims, 3 Drawing Sheets

JOINT STRUCTURE

FIELD OF THE INVENTION

The field relates to joint structures, and more particularly, to a joint structure comprising: a metallic pipe configured to transmit an electronic signal and enhanced with slash-free design; a resilient element completely enclosed by the metallic pipe and equipped with a positioning ring in seamless contact with the inner wall of the metallic pipe, such that the surface of the metallic pipe is free of breakages and sharp protrusions, wherein not only can the standing wave ratio and echo attenuation of a high-frequency signal being transmitted be minimized to thereby efficiently reduce the return loss and insertion loss of the signal, but the resilient element is provided with bumps for restricting expansion of the resilient element within the metallic pipe to thereby reduce the tendency of the resilient element to undergo metal fatigue, enhance the performance of the resilient element, increase the resilience of the resilient element, and boost the force required to plug and unplug the resilient element.

BACKGROUND

A conventional joint of a telecommunication or cable connection terminal typically comprises a resilient element that receives a terminal therein before being completely disposed in a metallic pipe configured for use in signal transmission. The conventional metallic pipe typically has longitudinal slashes for clamping the resilient element tightly. The main purpose of the conventional metallic pipe is to transmit high-frequency signals. However, the longitudinal slashes cause the signals to undergo different types of attenuation. To ensure tight engagement between the resilient element and the metallic pipe, it is necessary to increase the precision of the resilient element and the metallic pipe during a manufacturing process thereof, thereby incurring manufacturing costs. During an assembly process of the resilient element and the metallic pipe, the resilient element and the metallic pipe are joined together using an adhesive dispensing with a view to preventing them from loosening; however, when a terminal line is inserted into and removed from the resilient element, the resilient element disposed inside the metallic pipe expands. As a result, due to the plugging and unplugging of the resilient element and the terminal line, the metallic pipe having the longitudinal slashes expands from the slashes, thereby undergo metal fatigue, the slash angle widens, thereby being subjected to metal fatigue, and the resilience of the resilient element deteriorates as a result of the plugging and unplugging of a signal line, and the speeding-up of the attenuation of data transmission and strength.

SUMMARY OF THE INVENTION

In one example, the joint structure comprises a metallic pipe connected to a resilient element and enhanced with slash-free design, where the resilient element is integrally formed with a positioning ring circumferentially disposed at one end of the resilient element and bumps disposed at an opposing end of the resilient element, to efficiently reduce the return loss and insertion loss of signals. The joint structure is further characterized in that the resilient element is completely enclosed by the metallic pipe and engaged therewith out the need of adhesive-dispensing, so as to minimize the standing wave ratio and echo attenuation; the bumps regulates the angle of expansion of the resilient element, so as to reduce the tendency of the resilient element to undergo metal fatigue, boost the force required to plug and unplug the resilient element; and, due to the hermetic sealing of washers and a packing, the joint structure is waterproof.

DETAILED DESCRIPTION

Figure 1:
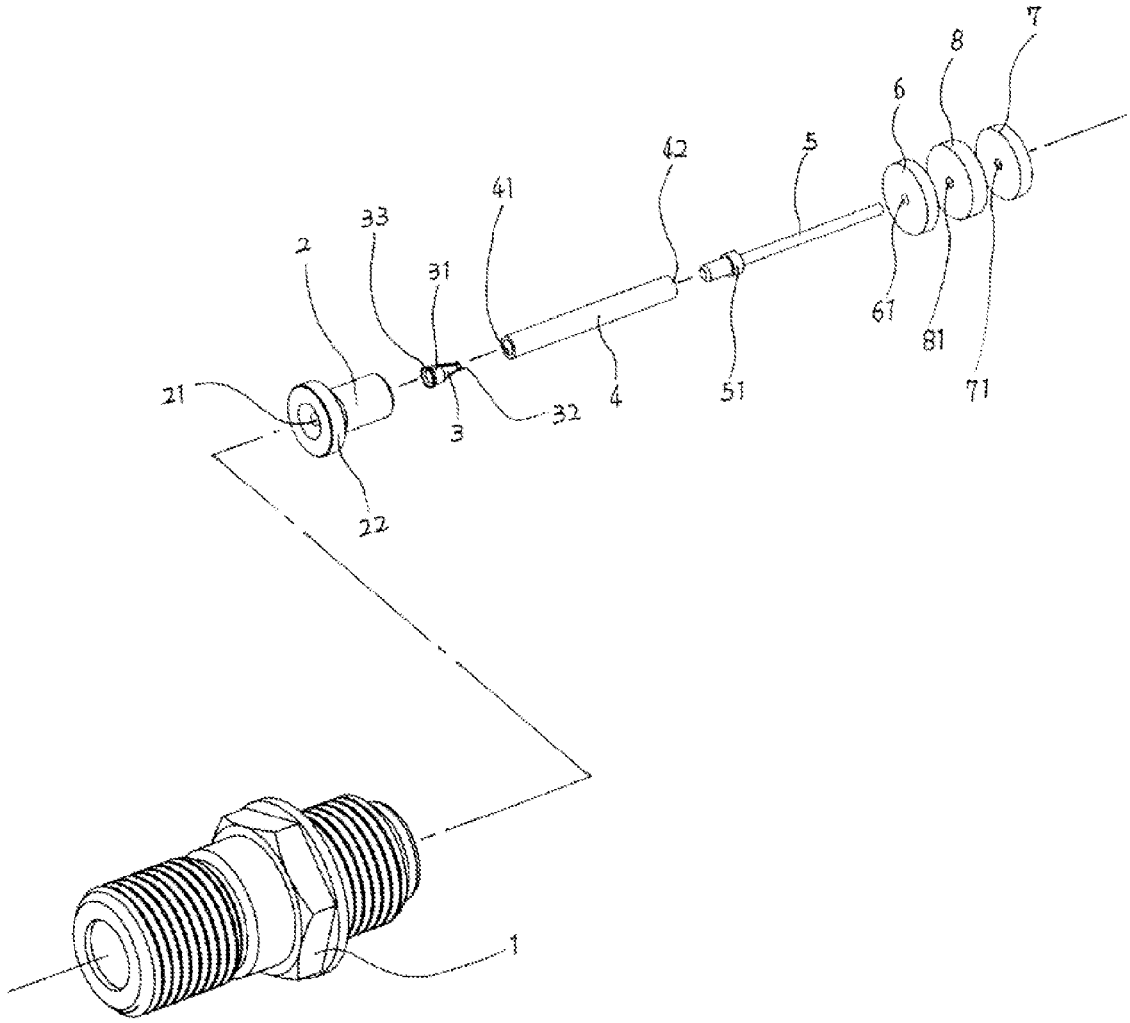
FIG. 1 is an exploded view of a joint structure according to one example.
Figure 2:
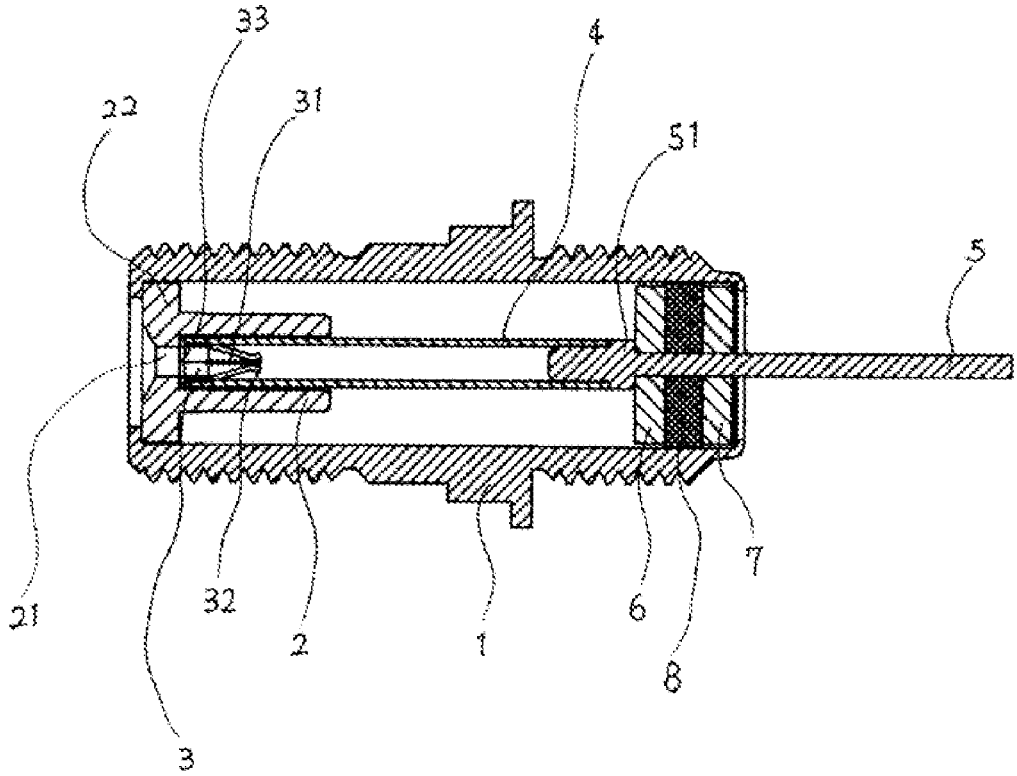
FIG. 2 is a cross-sectional view of the joint structure when assembled according to one example.

The examples and drawings provided in the detailed description are merely examples, which should not be used to limit the scope of the claims in any claim construction or interpretation Referring to FIGS. 1, 2, the joint structure in one example, comprises a body 1 provided externally with threads and provided internally with a cylindrical hollow core for accommodating a sleeve 2 therein. The sleeve 2 has a positioning ring 22 disposed at one end of the sleeve 2 and an aperture 21 disposed at a central portion of the sleeve 2. A resilient element 3 may be received inside the sleeve 2.

Figure 3:
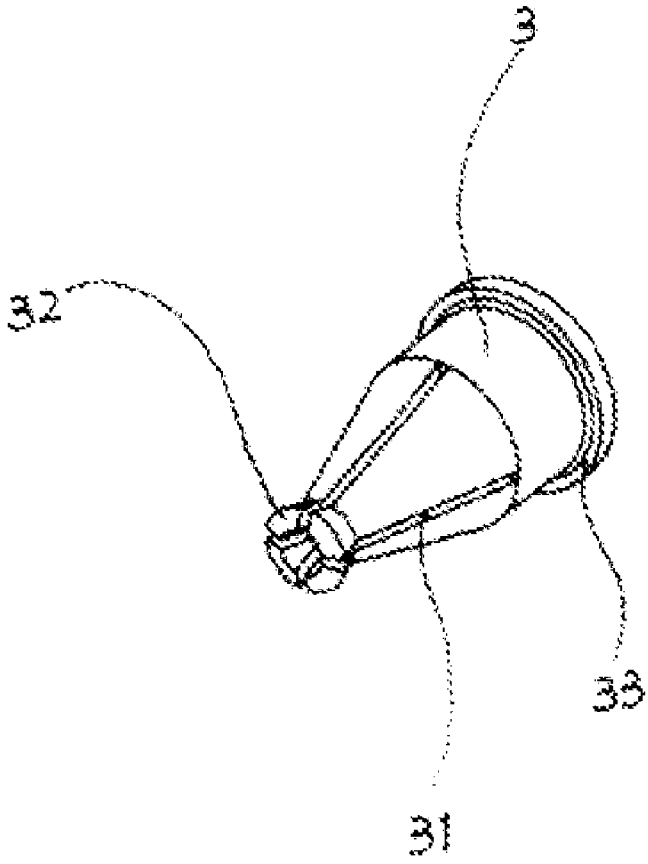
FIG. 3 is a schematic view of a resilient element according to one example.

Referring to FIGS. 1, 3, the circumference of the resilient element 3 is integrally formed as a unitary unit, and has a plurality of longitudinal slashes 31. A positioning ring 33 and at least one bump 32 are disposed at two ends of the resilient element 3, respectively. The resilient element 3 may be disposed in a hollow metallic pipe 4 in a manner that the joining portion of the resilient element 3 and the metallic pipe 4 is seamless and does not form any sharp protrusion. A rod 5 may be inserted into one end of the metallic pipe 4. The rod 5 has a positioning ring 51. A washer 6, a packing 8, and another washer 7 are disposed around the rod 5 from one end thereof. The positioning ring 51 enables the rod 5 and the metallic pipe 4 to be engaged with each other and positioned in place, thereby effectuating a waterproof function.

Referring to FIGS. 1, 2, an assembly of the joint structure in one example, comprises the steps of: inserting the resilient element 3 into the metallic pipe 4 through an aperture 41 thereof; inserting the metallic pipe 4 into the sleeve 2 such that the positioning ring 33 abuts against the sleeve 2 and the metallic pipe 4 to enable the resilient element 3 to be engaged and positioned in place; and inserting a terminal line (not shown) into the resilient element 3 such that the bump 32 abuts against the inner wall of the sleeve 2 to efficiently restrict the angle of expansion of the longitudinal slashes 31 of the resilient element 3. Hence, not only is the resilient element 3 unlikely to deform quickly and undergo metal fatigue, but the force required to plug and unplug the resilient element 3 is boosted.

The assembly of the joint structure in one example further includes the steps of: inserting the rod 5 into the metallic pipe 4 through an aperture 42 thereof; disposing the washer 6, the packing 8, and the washer 7 around the rod 5 in sequence through holes 61, 81, 71 centrally disposed therein, respectively; and inserting the resilient element 3, the metallic pipe 4, and the rod 5 into the body 1 so as for the positioning ring 22 of the sleeve 2 to abut against one end of the body 1 and the washer 6, the packing 8, and the washer 7 against an opposing, end of the body 1, thereby finalizing the assembly of the joint structure.

Thus, the joint structure in one example, comprises a resilient element equipped with a positioning ring and bumps disposed at each of the front ends of slashes of a metallic pipe treated with slash-free design to efficiently reduce return loss and insertion loss of signals. With the bumps restricting an angle of expansion of the resilient element, the resilient element is unlikely to undergo metal fatigue. Due to the waterproof hermetic sealing of washers and a packing, the resilient element and the metallic pipe may be engaged with each other without adhesive dispensing. The resilient element is integrally formed and enclosed in the metallic pipe, such that the joining portion of the resilient element and the metallic pipe is free of breakages and sharp protrusions, thereby minimizing the standing wave ratio and echo attenuation of high-frequency signals passing through the surface of the resilient element. Accordingly, the joint structure is useful and practical.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

LIST OF REFERENCE NUMERALS IN FIGURES

1. body
2. sleeve
21. aperture
22. positioning ring
3. resilient element
31. slash
32. bump
33. positioning ring
4. metallic pipe
41. aperture
42. aperture
5. rod
51. positioning ring
6. washer
61. hole
7. washer
71. hole
8. packing
81. hole

What is claimed is:

1. A joint structure, comprising:

a body provided internally with a hollow core, provided externally with threads, and connected to a cable terminal and an installation end;

a sleeve disposed in the body, wherein a positioning ring is disposed at an end of the sleeve;

a resilient element disposed in the sleeve and provided with longitudinal slashes, wherein a positioning ring and a bump are disposed at two ends of the resilient element, respectively; and a metallic pipe being slash-free and hollow and having an end with an aperture for admitting the resilient element and the other end having an aperture for admitting a rod; wherein the rod has a positioning ring disposed at an appropriate portion of the rod, the rod having an end insertable into the metallic pipe, and having another end for penetrating two washers and a packing, the washers and packing, being positioned at the positioning ring; and the packing being sandwiched between the two washers;

wherein the two washers and the packing are disposed around the rod and engaged with the body circumferentially and tightly; wherein the aforesaid elements together form the joint structure, such that the resilient element having the positioning ring facilitates assembling and positioning and efficiently reduces return loss and insertion loss of signals, and the bumps reduce metal fatigue of the resilient element.

2. A method of assembling the joint structure of claim 1, comprising:

inserting the resilient element into the metallic pipe, the metallic pipe having at the end of the pipe, the aperture for receiving the resilient element;

inserting the pipe into the sleeve such that the positioning ring of the resilient element abuts against the sleeve and the metallic pipe to enable the resilient element to be engaged and positioned in place;

inserting a terminal line into the resilient element such that the bump abuts against an inner wall of the sleeve to efficiently restrict the angle of expansion of the longitudinal slashes of the resilient element;

inserting the rod into the metallic pipe through the aperture of the other end of the pipe; and disposing the first washer of the two washers, the packing, and the second washer of the two washers, in sequence through their respective holes; and further inserting the resilient element, the metallic pipe, and the rod into the body such that the positioning ring of the sleeve abuts against one end of the body, the first of the two washers, the packing, and the second of the two washers, against an opposing end of the body.

* * * * *